US009799299B2

(12) United States Patent
Lai

(10) Patent No.: US 9,799,299 B2
(45) Date of Patent: Oct. 24, 2017

(54) GAMMA VOLTAGE GENERATION CIRCUIT, METHOD AND DATA DRIVER

(71) Applicants: BOE Technology Group Co., Ltd., Beijing (CN); Beijing BOE Display Technology Co., Ltd., Beijing (CN)

(72) Inventor: Yiqiang Lai, Beijing (CN)

(73) Assignees: BOE Technology Group Co. Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 0 days.

(21) Appl. No.: 14/477,012

(22) Filed: Sep. 4, 2014

(65) Prior Publication Data

US 2015/0379953 A1 Dec. 31, 2015

(30) Foreign Application Priority Data

Jun. 26, 2014 (CN) ..... 2014 1 0299904

(51) Int. Cl.

| | |
|---|---|
| ***G09G 3/36*** | (2006.01) |
| ***G09G 3/34*** | (2006.01) |
| *G09G 3/00* | (2006.01) |

(52) U.S. Cl.

CPC ..... *G09G 3/3696* (2013.01); *G09G 3/3413* (2013.01); *G09G 3/3607* (2013.01); (Continued)

(58) Field of Classification Search

None

See application file for complete search history.

(56) References Cited

U.S. PATENT DOCUMENTS

| | | | | |
|---|---|---|---|---|
| 8,803,862 | B2 * | 8/2014 | Lee | G09G 3/3655 338/295 |
| 2006/0022925 | A1 * | 2/2006 | Hara | G09G 3/3688 345/89 |

(Continued)

FOREIGN PATENT DOCUMENTS

| | | | |
|---|---|---|---|
| CN | 1453758 | A | 11/2003 |
| CN | 1728227 | A | 2/2006 |
| CN | 1873765 | A | 12/2006 |

OTHER PUBLICATIONS

Office Action, including Search Report, for Chinese Patent Application No. 201410299904.9, dated Nov. 4, 2015, 20 pages.

(Continued)

*Primary Examiner* — Seokyun Moon

(74) *Attorney, Agent, or Firm* — Westman, Champlin & Koehler, P.A.

(57) ABSTRACT

The present invention provides a Gamma voltage generation circuit and method and a data driver. The circuit includes multiple resistors connected in series, configured to generate multiple candidate voltages corresponding to non-linear regions of a voltage-light transmissivity curve, the number of the multiple candidate voltages being more than the number of Gamma voltages corresponding to the non-linear regions of the voltage-light transmissivity curve; and voltage selectors connected to common ends of every two adjacent resistors of the multiple resistors, configured to select at least one candidate voltage from the multiple candidate voltages as the Gamma voltage(s) corresponding to the non-linear regions of the voltage-light transmissivity curve so that an actual Gamma curve coincides with an ideal Gamma curve, each common end corresponding to a candidate voltage. The Gamma voltage generation circuit according to the present invention is applicable to display panels with different voltage-light transmissivity curves.

8 Claims, 4 Drawing Sheets

(52) U.S. Cl.
CPC ..... *G09G 3/006* (2013.01); *G09G 2320/0271* (2013.01); *G09G 2320/0276* (2013.01)

(56) References Cited

U.S. PATENT DOCUMENTS

| | | | | |
|---|---|---|---|---|
| 2006/0164354 | A1* | 7/2006 | Lee | G02F 1/136213 345/89 |
| 2010/0220119 | A1 | 9/2010 | Lee | |
| 2013/0082913 | A1 | 4/2013 | Chen et al. | |

OTHER PUBLICATIONS

Second Office Action for Chinese Patent Application No. 201410299904.9, dated May 19, 2016, 24 pages.
Rejection Decision for Chinese Patent Application No. 201410299904.9, dated Oct. 19, 2016, 30 pages.

* cited by examiner

GAMMA VOLTAGE GENERATION CIRCUIT, METHOD AND DATA DRIVER

CROSS-REFERENCE TO RELATED APPLICATION

This Application is a non-provisional Application of Chinese Application No. CN 201410299904.9, filed Jun. 26, 2014, in Chinese, the contents of which are hereby incorporated by reference in their entirety.

TECHNICAL FIELD

The disclosure relates to the field of display technologies, and more particularly, to Gamma voltage generation circuits, methods and data drivers.

BACKGROUND

A liquid crystal display panel includes multiple pixel units arranged in an array. Each pixel unit includes three sub-pixels which are red, green, and blue. A pixel electrode in each sub-pixel is connected to a Gamma voltage, which is used to control a display gray scale (i.e., brightness) of the sub-pixel. Voltage differences between Different Gamma voltages and common electrode voltages cause liquid crystal molecules to rotate differently, which in turn generates differences in the light transmissivities, thereby achieving the display of gray scale.

A Gamma voltage determination method comprises fitting a desired Gamma curve (i.e., an ideal Gamma curve) through a gray scale-light transmissivity curve of the liquid crystal display panel, and then calculating Gamma voltages corresponding to various gray scales according to the ideal Gamma curve and a Voltage-Light Transmissivity (V-T) curve of the liquid crystal display panel.

The Gamma voltages need to be generated by a corresponding Gamma voltage generation circuit. At present, the Gamma voltage generation circuit generally generates the Gamma voltages by way of voltage division with resistors in series, and resistances of resistors inside the circuit are calculated according to the determined Gamma voltages. Taking a 6-bit binary coded data driver as an example, a process of changing from all-white to all-black may be divided into $2^6$=64 gray scales, and it needs to generate 64 Gamma voltages. As shown in FIG. 1, a Gamma voltage generation circuit inside the data driver includes totally 63 resistors R0~R62 connected successively in series, which generates 64 Gamma voltages V0~V63, where V0, V1, V15, V31, V47, V62 and V63 are provided respectively in turn by external voltages Vr1~Vr7, and all remaining voltages need to be generated by voltage division with resistors.

However, it is found in a practical application process that an original Gamma voltage generation circuit will cause a deviation between the actual Gamma curve and the ideal Gamma curve, when the V-T curve of the liquid crystal display panel changes. Therefore, there is a need to redesign and modify the Gamma voltage generation circuit, which results in an extended production cycle (which typically is one month), considerably degrading the production efficiency.

SUMMARY

Embodiments of the present invention provide a Gamma voltage generation circuit and method and a data driver, to be applicable to different V-T curves, thereby improving the production efficiency.

In order to achieve the above purposes, the present invention uses the following technical solutions:

A Gamma voltage generation circuit, comprising: multiple resistors connected in series, configured to generate multiple candidate voltages corresponding to non-linear regions of a voltage-light transmissivity curve, the number of the multiple candidate voltages being more than the number of Gamma voltages corresponding to the non-linear regions of the voltage-light transmissivity curve; and voltage selectors connected to common ends of every two adjacent resistors of the multiple resistors, configured to select at least one candidate voltage from the multiple candidate voltages as the Gamma voltages corresponding to the non-linear regions of the voltage-light transmissivity curve so that an actual Gamma curve coincides with an ideal Gamma curve, each common end corresponding to a candidate voltage.

Preferably, there are one or more resistors between resistor common ends corresponding to two adjacent Gamma voltages in the Gamma voltages corresponding to the non-linear regions of the voltage-light transmissivity curve.

Preferably, resistances of the resistors between the resistor common ends corresponding to the two adjacent Gamma voltages are equal, when there are multiple resistors between the resistor common ends corresponding to the two adjacent Gamma voltages.

Preferably, the common ends of every two adjacent resistors of the multiple resistors are connected to one or more voltage selectors.

Preferably, the voltage selectors are connected to an external processor.

Preferably, the voltage selectors are connected to the external processor through an Inter-Integrated Circuit (I2C) communication interface.

Preferably, a degree of coincidence between the actual Gamma curve and the ideal Gamma curve increases with the increase of the number of the resistors corresponding to the non-linear regions of the voltage-light transmissivity curve.

The present invention further provides a Gamma voltage generation method applied in said Gamma voltage generation circuit, comprising: generating multiple candidate voltages corresponding to non-linear regions of a voltage-light transmissivity curve, the number of the multiple candidate voltages being more than the number of Gamma voltages corresponding to the non-linear regions of the voltage-light transmissivity curve; and selecting at least one candidate voltage from the multiple candidate voltages as the Gamma voltages corresponding to the non-linear regions of the voltage-light transmissivity curve, so that an actual Gamma curve coincides with an ideal Gamma curve.

The present invention further provides a data driver, comprising said Gamma voltage generation circuit.

In the Gamma voltage generation circuit and method and data driver according to the embodiments of the present invention, the number of resistors corresponding to the non-linear regions of the voltage-light transmissivity curve in the Gamma voltage generation circuit is increased so that the number of multiple voltages generated by the resistors corresponding to the non-linear regions is more than the number of required Gamma voltages, and then voltages selectors connected to the generated multiple voltages as candidate voltages. Suitable voltages can be selected from multiple candidate voltages as the Gamma voltages corresponding to the non-linear regions of the voltage-light transmissivity curve only by the voltage selectors according to the voltage-light transmissivity curve with reference to the ideal Gamma curve, when the voltage-light transmissivity curve changes, so that the actual Gamma curve coincides with the ideal Gamma curve, without redesigning and modifying the Gamma voltage generation circuit. This considerably improves the production efficiency.

BRIEF DESCRIPTION OF THE DRAWINGS

In order to more clearly illustrate the technical solutions in the embodiments of the present invention, accompanying drawings needed to be used in the description of the embodiments will be simply described below. Obviously, the accompanying drawings in the following description are merely some embodiments of the present invention. Those skilled in the art can understand that other accompanying drawings can be obtained according to these accompanying drawings without any creative labor.

DETAILED DESCRIPTION OF THE EMBODIMENTS

In order to make the above purposes, features and advantages of the present invention more obvious and understandable, the technical solutions in the embodiments of the present invention will be described more clearly and completely below in conjunction with accompanying drawings in the embodiments of the present invention. Obviously, the described embodiments are merely a part of the embodiments of the present invention instead of all the embodiments. All other embodiments made by those skilled in the art on basis of the embodiments of the present invention should be included in the protection scope of the present invention.

Figure 1:
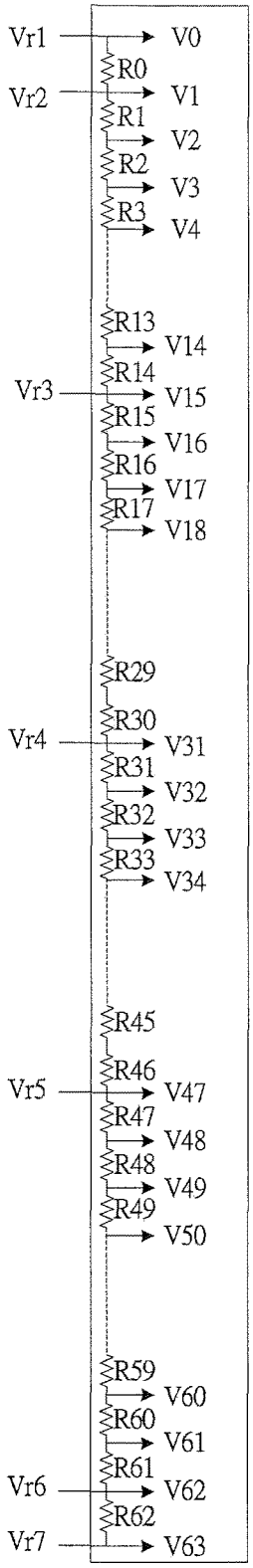
FIG. 1 is a structural diagram of a Gamma voltage generation circuit conventionally.
Figure 2:
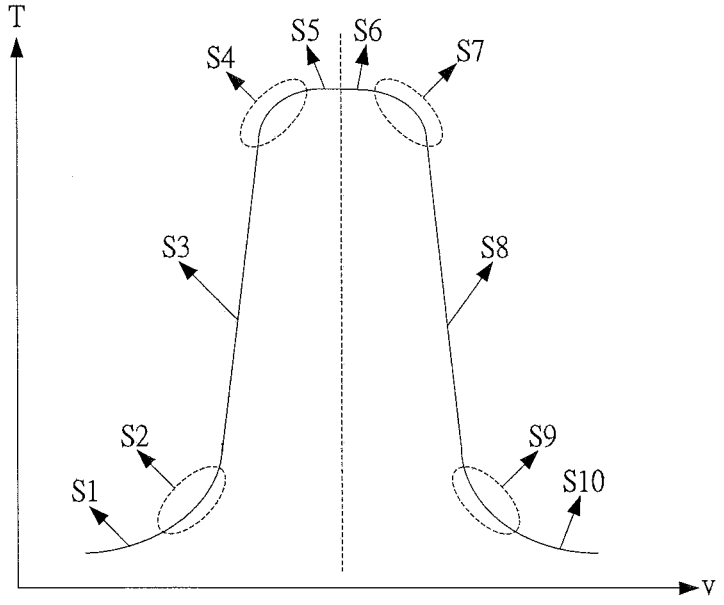
FIG. 2 is a voltage-light transmissivity curve of a display panel.

In general, voltages and light transmissivities of a display panel are not completely in a linear relationship, and a V-T curve thereof comprises linear regions and non-linear regions. The V-T curve of the display panel is as shown in FIG. 2. A left half (i.e., a part on the left of a dotted line) of the curve is a V-T curve when a negative voltage is applied, and a right half (i.e., a part on the right of the dotted line) of the curve is a V-T curve when a positive voltage is applied. Corresponding voltages have the same values but opposite polarities when the light transmissivities of the left half and the right half are the same, where S1, S3, S5, S6, S8 and S10 are linear regions, and S2, S4, S7 and S9 are non-linear regions.

As various Gamma voltages for controlling display of different gray scales are determined based on the V-T curve of the display panel, there is a correspondence between the various Gamma voltages and the V-T curve. Only a few of the Gamma voltages are generated by externally applying voltages on the Gamma voltage generation circuit, and remaining most Gamma voltages are generated by voltage division with a series of resistors inside the Gamma voltage generation circuit. Contiguous points between the linear regions and the non-linear regions of the V-T curve corresponding to the Gamma voltages provided by the external voltages are generally set. Therefore, these Gamma voltages provided by the external voltages are also referred to as binding point voltages. Gamma voltages corresponding to the interiors of the linear regions and the non-linear regions are set as being generated by voltage division with a series of resistors.

Gamma voltages generated by the original Gamma voltage generation circuit fail to meet the requirements of the light transmissivities of the changed V-T curve on voltages, which results in a deviation of the light transmissivities, when the V-T curve of the display panel changes, for example, when the same Gamma voltage generation circuit is used in different display panels (which have different V-T curves), thereby causing an error in the display of gray scales. That is, it results in the actual Gamma curve of the display panel deviating from the ideal Gamma curve, thereby degrading the picture display effects.

In this case, it needs to adjust the Gamma voltages generated by the Gamma voltage generation circuit according to the changed V-T curve. The inventor founds that in a linear region of the V-T curve, the corresponding Gamma voltages and the light transmissivities are in a linear relationship, and slopes at various points are the same. Various changed Gamma voltages inside an interval of binding point voltages corresponding to the linear region can be changed in proportion to those before the change of the V-T curve by adjusting the binding point voltages. Thereby, the slopes of the linear region uniformly change to another value, achieving the purpose of the Gamma curve which corresponds to the linear region coinciding with an ideal Gamma curve. In a non-linear region of the V-T curve, the corresponding Gamma voltages and the light transmissivities are in a non-linear relationship, and slopes at various points are different. If only the binding point voltages corresponding to the non-linear region are adjusted at this time, various Gamma voltages inside an interval of the binding point voltages will change according to an original condition of the voltage division with resistors. However, the changed Gamma voltages not necessarily coincide with required Gamma voltages for displaying corresponding gray scales. Therefore, it needs to adjust the resistors in the original Gamma voltage generation circuit which correspond to the non-linear region of the V-T curve, when the V-T curve of the display panel changes, so that the Gamma curve which corresponds to the non-linear region coincides with an ideal Gamma curve.

However, for a particular display panel, once a Gamma voltage generation circuit matched with the V-T curve has been produced, resistances of various resistors in the series of resistors in the circuit have been fixed. If it needs to adjust resistances of certain resistors, it needs to redesign the circuit, determine the required resistances of the resistors, and then desolder and substitute the corresponding resistors, which is a quite time-consuming process.

In view of this, the present embodiment provides a Gamma voltage generation circuit, in which improvements are made on the setting of the resistors corresponding to non-linear regions of the V-T curve. The Gamma voltage generation circuit comprises: multiple resistors connected in series, configured to generate multiple candidate voltages corresponding to non-linear regions of a voltage-light transmissivity curve, the number of the multiple candidate voltages is more than the number of Gamma voltages corresponding to the non-linear regions of the voltage-light transmissivity curve; and voltage selectors connected to common ends of every two adjacent resistors of the multiple resistors, configured to select at least one candidate voltage from the multiple candidate voltages as the Gamma voltages corresponding to the non-linear regions of the voltage-light transmissivity curve so that an actual Gamma curve coincides with an ideal Gamma curve, each common end corresponding to a candidate voltage.

It should be illustrated that due to many factors such as limitations on processes, limitations on materials, losses in a practical use process, and the like, the actual Gamma curve of the display panel is impossible to completely coincide with the ideal Gamma curve. Therefore, "the actual Gamma curve coincides with the ideal Gamma curve" in the present embodiment refers to the actual Gamma curve being approximate to the ideal Gamma curve as much as possible within an allowable error range.

In the above Gamma voltage generation circuit, the number of resistors corresponding to the non-linear regions of the voltage-light transmissivity curve is more than the number of resistors required to generate Gamma voltages corresponding to the non-linear regions, so that the number of generated voltages is more than the number of required Gamma voltages corresponding to the non-linear regions. The generated voltages are used as candidate voltages, and suitable voltages can be selected from multiple candidate voltages as the Gamma voltages corresponding to the non-linear regions of the voltage-light transmissivity curve only by voltage selectors according to the voltage-light transmissivity curve with reference to the ideal Gamma curve, when the voltage-light transmissivity curve changes, so that the actual Gamma curve coincides with the ideal Gamma curve, without redesigning and modifying the Gamma voltage generation circuit. This enables the above Gamma voltage generation circuit to be applicable to multiple V-T curves, thereby improving the production efficiency.

The above description is the core idea of the present application. On basis of this core idea, the specific structure and operation process of the Gamma voltage generation circuit according to the present embodiment will be described in detail below by taking a 6-bit binary coded data driver as an example.

With 6-bit binary coding, a process of the display panel changing from all-white to all-black may be divided into $2^6=64$ gray scales, which needs to generate 64 Gamma voltages.

A process of determining the 64 Gamma voltages comprises obtaining a gray scale-light transmissivity curve of the display panel through an actual test; normalizing the gray scale-light transmissivity curve to fit a desired ideal Gamma curve of the display panel, wherein the Gamma curve can characterize a correspondence between gray scales and light transmissivities, and has a constant Gamma value, which typically is 2.2 at present; and deriving light transmissivities corresponding to different gray scales according to the obtained Gamma curve, obtaining voltages corresponding to different gray scales according to the V-T curve of the display panel, and then calculating the 64 Gamma voltages.

Figure 3:
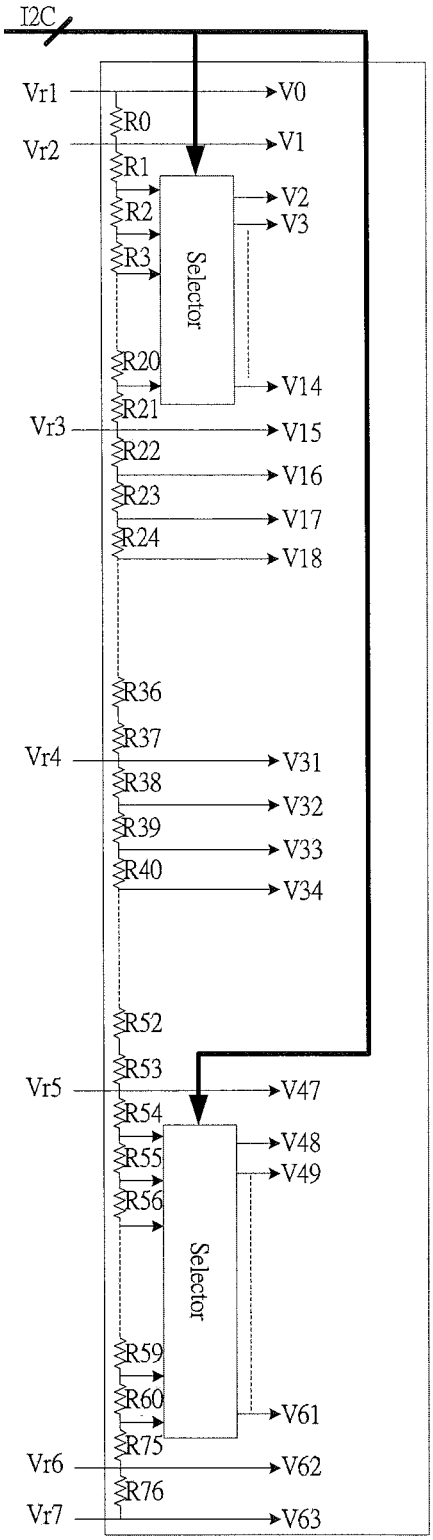
FIG. 3 is a structural diagram of a Gamma voltage generation circuit according to an embodiment of the present invention.

The Gamma voltage generation circuit is designed according to the calculated 64 Gamma voltages, and the number of resistors corresponding to the non-linear regions of the V-T curve is increased, so that the number of resistors included in these regions is more than the number of resistors required to generate the Gamma voltages corresponding to these regions. The specific structure of the 6-bit binary coded Gamma voltage generation circuit is as shown in FIG. 3, and includes totally 77 resistors R0~R76 connected in series and two voltage selectors. The series of resistors can generate 76 voltages, from which totally 64 voltages V0~V63 may be selected by the voltage selectors as the Gamma voltages for displaying the 64 gray scales.

Specifically, taking all generated voltages being negative as an example, the series of resistors in the circuit and the generated voltages correspond to the left half of the V-T curve. Assume that the 7 Gamma voltages V0, V1, V15, V31, V47, V62 and V63 from the 64 Gamma voltages, which correspond to a start point, an end point, and contiguous points between the linear regions and the non-linear regions of the left half of the V-T curve, are used as binding point voltages and are provided in turn by external voltages Vr1, Vr2, Vr3, Vr4, Vr5, Vr6 and Vr7. Then a resistor R0 and a voltage interval Vr1~Vr2 correspond to a linear region S1, resistors R1~R21 and a voltage interval Vr2~Vr3 correspond to a non-linear region S2, resistors R22~R53 and a voltage interval Vr3~Vr5 correspond to a linear region S3, resistors R54~R75 and a voltage interval Vr5~Vr6 correspond to a non-linear region S4, and a resistor R76 and a voltage interval Vr6~Vr7 correspond to a linear region S5.

In addition to the 7 binding point voltages provided by the external voltages, Gamma voltages required to be generated in the voltage interval Vr2~Vr3 corresponding to the non-linear region S2 are totally 13 Gamma voltages V2~V14, which otherwise would have needed 14 resistors. In the present embodiment, the number of resistors may increase from 14 to 21 (i.e., R1~R21). The 21 resistors may generate 20 voltages as candidate voltages, from which 13 voltages are selected by the voltage selectors according to the V-T curve as Gamma voltages for output. Gamma voltages required to be generated in the voltage interval Vr5~Vr6 corresponding to the non-linear region S4 are totally 14 Gamma voltages V48~V61, which would have needed 15 resistors normally. In the present embodiment, the number of resistors may increase from 15 to 22 (i.e., R54~R75). The 22 resistors may generate 21 voltages as candidate voltages, from which 14 voltages are selected by the voltage selectors according to the V-T curve as Gamma voltages for output.

As the number of resistors corresponding to the non-linear regions of the V-T curve is increased, the number of voltages which can be generated by the series of resistors corresponding to the non-linear regions is increased. Therefore, these voltages can be used as candidate voltages for the Gamma voltages required to be generated which correspond to the non-linear regions. Then candidate voltages which can enable the actual Gamma curve more approximate to the ideal Gamma curve can be selected by the voltage selectors from these candidate voltages (for a common Gamma curve with a Gamma value equal to 2.2, candidate voltages which can enable the Gamma value more close to 2.2 are selected) as final Gamma voltages corresponding to the non-linear regions for output. Thereby, it leaves room for selection so as to adjust the resistances of the resistors in the circuit when the V-T curve changes, so that the Gamma voltage generation circuit according to the present embodiment can be applicable to different V-T curves. This saves the time wasted on operations such as redesigning the circuit, desoldering the resistors, substituting the resistors etc. when the V-T curve changes conventionally, thereby considerably improving the production efficiency of the products.

It should be illustrated that the above description is made by taking a number of resistors corresponding to the non-linear regions of the V-T curve being increased by 7 as an example. On basis of the core idea of the present invention, the number of the increased resistors for the non-linear regions of the V-T curve may be set according to practical requirements.

In practice, a degree of coincidence between the actual Gamma curve and the ideal Gamma curve increases with the number of the resistors corresponding to the non-linear regions of the V-T curve. That is, the more the number of the resistors corresponding to the non-linear regions is increased, the larger the selectable range of the Gamma voltages corresponding to the non-linear regions when the V-T curve changes is, the higher the accuracy of the Gamma voltages is, and therefore, the closer the actual Gamma curve is to the ideal Gamma curve finally.

In consideration of the production cost and occupied chip area will increase with the increase of the number of the resistors corresponding to the non-linear regions, in a practical design, the Gamma voltage generation circuit can be reasonably designed by taking a balance point between the accuracy of the Gamma curve and the production cost and chip area according to the requirements on the accuracy of the Gamma curve and the requirements on the production cost and chip area.

In the present embodiment, the number of resistors corresponding to the non-linear regions is set to be more than the number of resistors required to generate Gamma voltages corresponding to these regions. In a practical design, there may preferably be one or more resistors between resistor common ends corresponding to two adjacent Gamma voltages in the Gamma voltages corresponding to the non-linear regions of the V-T curve. That is, a resistor originally for generating a certain Gamma voltage may be subdivided into multiple small resistors. More preferably, resistances of the resistors between the resistor common ends corresponding to the two adjacent Gamma voltages may be the same, when there are multiple resistors between resistor common ends corresponding to two adjacent Gamma voltages. That is, a resistor originally for generating a certain Gamma voltage is divided equally into multiple small resistors, thereby further improving the accuracy of the finally selected Gamma voltages.

It should be illustrated that the present embodiment is described by taking the above arrangement method of various resistors corresponding to the non-linear regions of the V-T curve as an example. However, it is not intended to limit the technical solutions of the present invention. Those skilled in the art can devise other arrangement solutions of various resistors corresponding to the non-linear regions from the core idea of the present invention. For example, a resistor originally for generating a certain Gamma voltage is subdivided according to a particular design, or two originally adjacent resistors are combined and then subdivided into three resistors, and the like.

In the present embodiment, resistors corresponding to one non-linear region of the V-T curve of the display panel may be connected to one or more voltage selectors. Simply, the non-linear region and the voltage selectors may be in a one-to-one correspondence or a one-to-more correspondence. For example, with respect to the Gamma voltage generation circuit illustrated in FIG. 3, common ends of every two adjacent resistors in the resistors R1~R21 corresponding to the non-linear region may be connected to one voltage selector to simplify the circuit structure, or may be connected to multiple voltage selectors to more flexibly control the selection of the candidate voltages.

The voltage selectors in the Gamma voltage generation circuit may preferably be connected to an external processor, to control the selection of the voltage selectors and the output of the Gamma voltages complying with requirements. The voltage selectors may preferably be connected to the external processor through an I2C communication interface, to achieve high-speed communication between the voltage selectors and the external processor.

Figure 4:
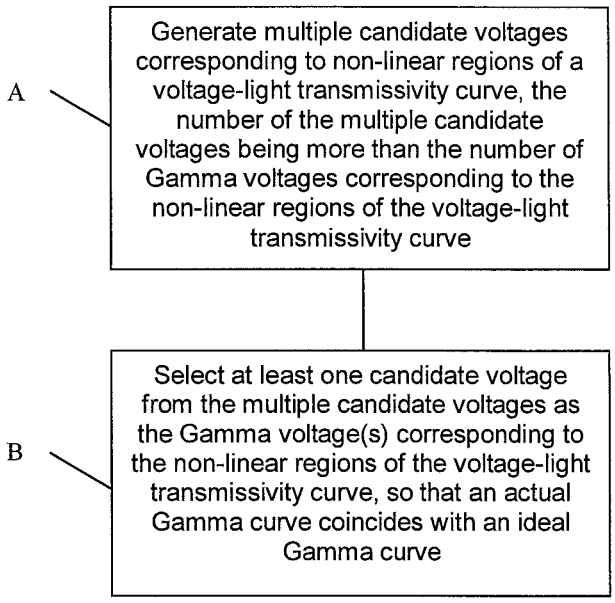
FIG. 4 is a flowchart of a Gamma voltage generation method according to an embodiment of the present invention.

As shown in FIG. 4, the present embodiment further provides a Gamma voltage generation method applied to the Gamma voltage generation circuit according to the present embodiment. The Gamma voltage generation method comprises the following steps:

Step A: generating multiple candidate voltages corresponding to non-linear regions of a voltage-light transmissivity curve, the number of the multiple candidate voltages being more than the number of Gamma voltages corresponding to the non-linear regions of the voltage-light transmissivity curve; and Step B: selecting at least one candidate voltage from the multiple candidate voltages as the Gamma voltages corresponding to the non-linear regions of the voltage-light transmissivity curve, so that an actual Gamma curve coincides with an ideal Gamma curve.

In the above Gamma voltage generation method, by firstly generating candidate voltages of which the number is more than the number of required Gamma voltages corresponding to the non-linear regions of the V-T curve, and then selecting suitable candidate voltages from these candidate voltages as the Gamma voltages corresponding to non-linear regions of the V-T curve, the actual Gamma curve can be more close to the ideal Gamma curve after the V-T curve of the display panel changes. This avoids redesigning and modifying the Gamma voltage generation circuit, considerably improving the production efficiency.

The present embodiment further provides a data driver, comprising the Gamma voltage generation circuit according to the present embodiment. As the Gamma voltage generation circuit according to the present embodiment can be applicable to different V-T curves, the data driver according to the present embodiment can drive display panels with different V-T curves. This saves the time spent on designing and producing data drivers corresponding to the display panels with different V-T curves, thereby improving the production efficiency.

The above description is only the specific implementations of the present invention, and in not intended to limit the protection scope of the present invention. Any change or substitution, which is easily reached by those skilled in the art within the technical scope disclosed by the present invention, should be included in the protection scope of the present invention. Therefore, the protection scope of the present invention is defined by the protection scope of the claims.

What is claimed is:

1. A Gamma voltage generation circuit, comprising:

multiple external voltage terminals, configured to receive respective external voltages, and provide these external voltages to be directly used as Gamma voltages for points at each of which linear region is connected to a non-linear region of a voltage-light transmissivity curve, multiple groups of serially connected resistors, each group configured to generate multiple candidate voltages for the non-linear regions of the voltage-light transmissivity curve at respective common ends of every two adjacent resistors of the group, the number of the multiple candidate voltages being more than the number of Gamma voltages for the non-linear region; and multiple voltage selectors corresponding to the multiple groups of serially connected resistors, each voltage selector connected to respective common ends of every two adjacent resistors of a corresponding group, and configured to select from the multiple candidate voltages generated by the corresponding group the Gamma voltages for the non-linear region.

2. The Gamma voltage generation circuit according to claim 1, wherein, there are one or more resistors between any neighboring common ends at which the Gamma voltages for the non-linear region are generated in each group.

3. The Gamma voltage generation circuit according to claim 2, wherein, resistances of the resistors between neighboring common ends are equal, when there are more than one resistor between the neighboring common ends.

4. The Gamma voltage generation circuit according to claim 1, wherein, the multiple voltage selectors are connected to an external processor.

5. The Gamma voltage generation circuit according to claim 4, wherein, the multiple voltage selectors are connected to the external processor through an Inter-Integrated Circuit communication interface.

6. The Gamma voltage generation circuit according to claim 1, wherein, a degree of coincidence between an actual Gamma curve and an ideal Gamma curve increases with the increase of the number of the resistors.

7. A Gamma voltage generation method, comprising:

providing multiple external voltage at multiple external voltage terminals to be directly used as Gamma voltages for points at each of which a linear region is connected to a non-linear region of a voltage-light transmissivity curve;

generating multiple candidate voltages for a non-linear region of the voltage-light transmissivity curve at respective common ends of every two adjacent resistors of a group of serially connected resistors, the number of the multiple candidate voltages being more than the number of Gamma voltages for the non-linear region; and selecting from the multiple candidate voltages the Gamma voltages for the non-linear region.

8. A data driver, comprising the Gamma voltage generation circuit according to claim 1.

* * * * *